United States Patent [19]

Palumbo et al.

[11] 4,108,731

[45] Aug. 22, 1978

[54] COKE PRODUCTION

[75] Inventors: Luigi Palumbo; Angelo Colletta; Giampaolo Giromella, all of Rome, Italy

[73] Assignee: Centro Sperimentale Metallurgico S.p.A., Rome, Italy

[21] Appl. No.: 733,176

[22] Filed: Oct. 18, 1976

Related U.S. Application Data

[63] Continuation of Ser. No. 528,393, Nov. 29, 1974, abandoned.

[30] Foreign Application Priority Data

Nov. 29, 1973 [IT] Italy ..... 53985 A/73

[51] Int. Cl.[2] ..... C10B 47/24; C10B 49/10; C10B 53/04; C10B 57/02

[52] U.S. Cl. ..... 201/8; 201/5; 201/28; 201/29; 201/31; 201/36; 201/38; 201/44

[58] Field of Search ..... 201/5, 8, 14, 28, 29, 201/31, 36, 38, 44

[56] References Cited

U.S. PATENT DOCUMENTS

| | | | |
|---|---|---|---|
| 2,131,702 | 9/1938 | Berry | 201/36 X |
| 2,650,190 | 8/1953 | Steinschlaeger | 201/29 |
| 2,955,077 | 10/1960 | Welinsky | 201/31 X |
| 3,051,629 | 8/1962 | Gorin et al. | 201/36 X |
| 3,076,751 | 2/1963 | Minet | 201/31 |
| 3,140,241 | 7/1964 | Work et al. | 201/5 |
| 3,140,242 | 7/1964 | Work et al. | 201/5 |
| 3,184,293 | 5/1965 | Work et al. | 201/6 X |
| 3,375,175 | 3/1968 | Eddinger et al. | 201/44 X |
| 3,414,480 | 12/1968 | Stotler et al. | 201/8 X |
| 3,444,046 | 5/1969 | Harlow | 201/8 |
| 3,574,065 | 4/1971 | Eddinger et al. | 201/44 X |
| 3,843,458 | 10/1974 | Kemmetmueller | 201/44 X |
| 3,996,108 | 12/1976 | Joseph | 201/8 X |

*Primary Examiner*—Morris O. Wolk
*Assistant Examiner*—Michael S. Marcus
*Attorney, Agent, or Firm*—Young & Thompson

[57] ABSTRACT

Coke is produced with high yield and low sulfur by heating and drying ground coking coal at 200° to 300° C. for 15 to 120 minutes in air, and then heating in two semicoking stages in nitrogen in fluidized bed reactors. The first semicoking stage is 400° to 600° C. for 10 to 60 minutes while the second is 800° to 1,100° C. for 10 to 60 minutes. Tar is condensed from the offgases of the first semicoking stage and the residual gas is divided and 15 to 95% recycled to the first semicoking reactor. Similarly, 15 to 95% of the offgases from the second semicoking reactor is recycled. The condensed tar is fed to the final coke-forming operation.

1 Claim, 1 Drawing Figure

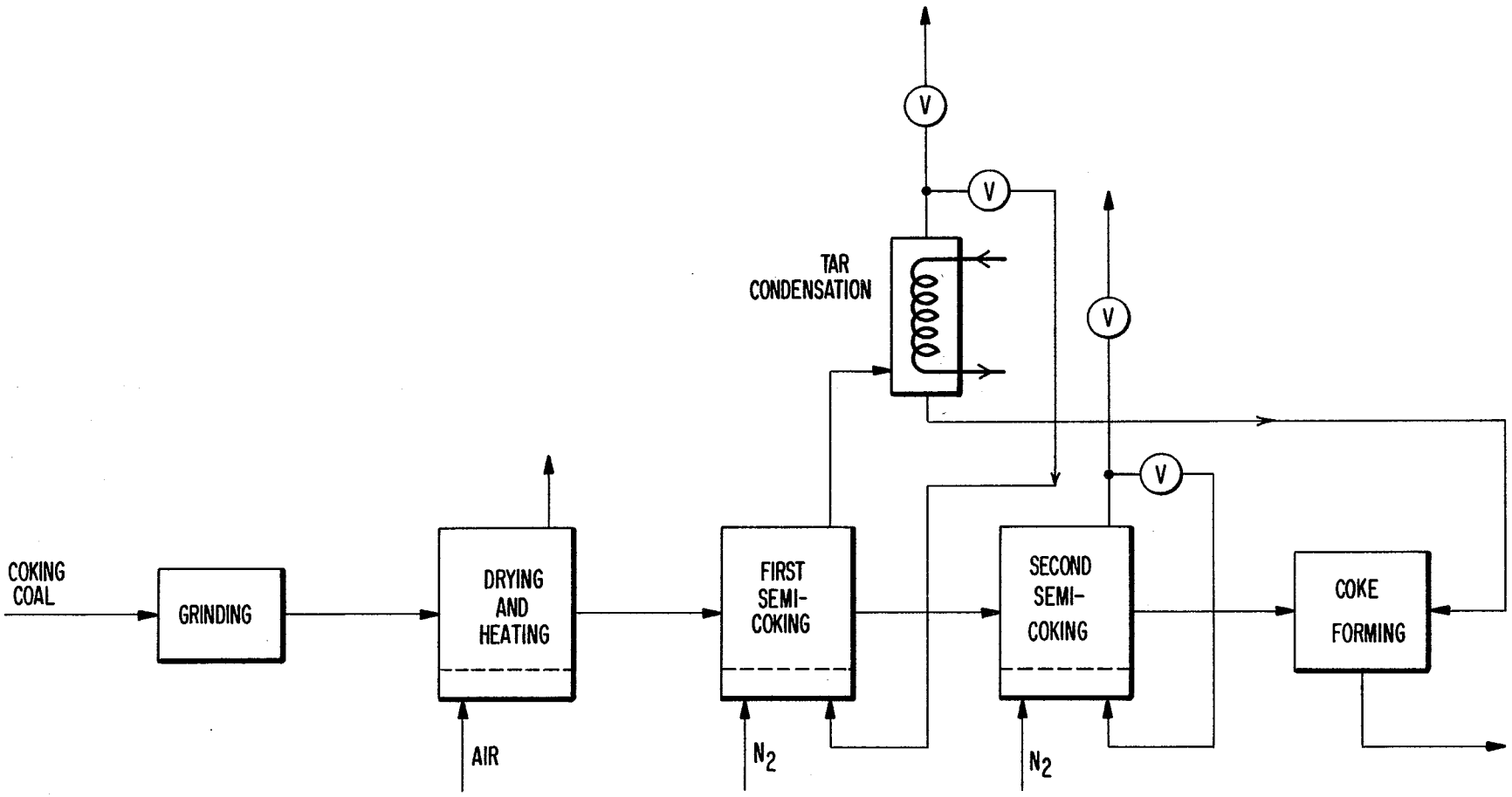
COKING COAL
GRINDING
DRYING AND HEATING
AIR
FIRST SEMI-COKING
$N_2$
TAR CONDENSATION
SECOND SEMI-COKING
$N_2$
COKE FORMING
V
V
V
V

COKE PRODUCTION

This is a continuation, of application Ser. No. 528,393, filed Nov. 29, 1974 and now abandoned.

The present invention relates to coke production by continuous multi-stage fluidized bed techniques.

In known coke producing processes of the continuous multi-stage fluidized bed type, the following steps are performed:

1. Grinding of the coal;

2. An oxidation phase characterized by heating of the ground coal in a fluidized bed in the presence of oxygen, to remove any cokifying and agglomerating potential and to create conditions for the formation of peroxides which favor the subsequent polymerization of the product;

3. Heating in a fluidized bed reactor at temperatures below 500° C., to eliminate some of the constituents of the coal which are driven off as vapors and condense as tar, the tar being subsequently used as a binder in the briquette-forming phase;

4. A calcination phase characterized by heating to temperatures of around 900° C. to eliminate the less volatile fractions;

5. Cooling of the thus-obtained semicoke to temperatures such as to prevent ignition of the material upon contact with the air; and 6. A coke-forming phase characterized by briquette forming, hardening and baking.

However, these known techniques have not proven to be entirely satisfactory, since they give only a low yield from the raw material and also produce a coke which has a high sulfur content, which sulfur is of course detrimental in subsequent metallurgical uses of the coke.

Accordingly, it is an object of the present invention to provide methods for coke production, in which the yield is increased.

Another object is the provision of such methods in which the resulting coke has relatively low sulfur.

Still another object of the present invention is the provision of such methods which will be relatively easy and inexpensive to practice, and dependable in result.

Briefly, the objects of the present invention are achieved by providing continuous methods for coke production, characterized by the following steps, to be read in connection with the accompanying drawing which is a schematic flow diagram of the process according to the present invention:

1. Grinding;

2. Drying and heating in a fluidized bed reactor with supply of a gas which is 50–100% by volume air, 0–50% by volume steam, and 0–50% by volume nitrogen, at temperatures between 200° and 300° C. for a period of 15 to 120 minutes. The offgases from this drying and heating step are vented owing to their leanness, that is their low heating value;

3. A first semicoking step characterized by heating in a fluidized bed reactor with the introduction of make-up gas which is 50 to 100% by volume nitrogen, 0 to 20% by volume air and 0 to 50% by volume steam, at temperatures from 400° to 600° C. for a period of 10 to 60 minutes. The offgases from this first semicoking step are cooled to 15° to 95° C. to condense tars, the tars being then sent to the subsequent briquetting operation. The remaining gaseous mixture is divided and 15 to 95% by volume recycled to the first semicoking reactor, the remainder being collected for use in other processes in the metallurgical and chemical industries. Both the make-up gas and the recycled gas are used to fluidize the bed;

4. A second semicoking step characterized by heating in a fluidized bed reactor with the introduction of make-up gas which is 30 to 100% by volume nitrogen and 0 to 70% by volume air, at a temperature of 800 to 1,100° C. for 10 to 60 minutes. The offgases are divided and 15 to 95% thereof recycled to the second coking reactor, the balance being useful without further processing as a reducing agent in blast furnaces, in direct reduction plants or for any type of chemical process. Again, both the make-up gas and the recycled gas are used to fluidize the bed; and 5. Transformation of the semicoke into formed coke by conventional processes as above.

It will of course be understood that the unrecycled portion of the offgases from the semicoking steps is equal to the distillation gases from the respective steps because the amount of the fluidization gas is constant under steady or equilibrium conditions.

In order to enable those skilled in this art to practice the invention, the following illustrative example is given merely by way of illustration and not in any limitative sense:

EXAMPLE

Forty pounds per hour of a conventional coking coal containing 25% by weight of volatile matter, 0.64% sulfur and 6.23% ash is subjected to the following steps:

1. Grinding to a grain size between 16 and 150 mesh;

2. Heating and drying at 260° C. in a fluidized bed reactor supplied with air as make-up gas at a flow rate of 6.3 cubic meters per hour measured at 20° C. and 1.1 atmosphere absolute, for 30 minutes;

3. A first semicoking step at 450° C. in a fluidized bed reactor supplied with nitrogen at a flow rate of 4.3 cubic meters per hour measured at 20° C. and 1.1 atmosphere absolute, for 30 minutes. The offgases from this reactor are cooled to 55° C. to condense tar which is sent to the subsequent briquetting operation. The residual gas is divided into two parts, and one part equal to 95% by volume is recycled to the first semicoking reactor and has a volume composition of oxygen 0.5%, methane 28.6%, carbon monoxide 14.3%, carbon dioxide 40.3%, ethane 14.3% and nitrogen 2.0%. The unrecycled portion is collected for other uses as explained above;

4. A second semicoking step at 870° C. in a fluidized bed reactor supplied with nitrogen at a flow rate of 2 cubic meters per hour, measured at 20° C. and 1.1 atmosphere absolute, for 30 minutes. The offgases from the reactor are divided into two parts, one of which is 70% by volume and is recycled to the second semicoking reactor and has a volume composition of 65% hydrogen, 12.1% nitrogen, 0.4% oxygen, 0.5% carbon dioxide, 20.0% carbon monoxide and 2.0% methane. The remaining 30% is collected for another use as described above; and 5. A conventional coke-forming operation in which the semicoke is cooled and blended with the tar and cold-briquetted and the green briquettes thus produced are hardened at 850° C. for one hour.

The following table sets forth a comparison of the properties of the semicoke and semicoking gases obtained by the present invention as compared to those of the conventional process initially described:

| | The Invention | Conventional Process |
|---|---|---|
| Net heat value of first semicoking gas | 5100 kcal/Nm$^3$ | 100 kcal/Nm$^3$ |
| Net heat value of second semicoking gas | 2440 kcal/Nm$^3$ | 900 kcal/Nm$^3$ |
| Sulfur content of semicoke | 0.40% | 0.61% |
| Reactivity in cm$^3$/g.s. | 0.61 | 0.86 |

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

Having described our invention, we claim:

1. In a method of producing coke, comprising grinding coking coal containing about 0.64% by weight sulfur, drying and heating the ground coal at a temperature of 200° to 300° C. for 15 to 120 minutes by fluidizing the ground coal with gas consisting essentially of 50 to 100% by volume air, 0 to 50% by volume steam and 0 to 50% by volume nitrogen in addition to that present in said air thereby to produce a dried and heated material; passing said material to a first semicoking stage, heating said material by fluidization in said first semicoking stage at 400° to 600° C. for 10 to 60 minutes while supplying to said first semicoking stage a make-up fluidizing gas comprising 0 to 20% by volume air, 50 to 100% by volume nitrogen in addition to that present in said air, and 0 to 50% by volume steam, thereby to produce semicoke and offgases; cooling said offgases to produce condensed tar and residual gases; passing the semicoke from said first semicoking stage to a second semicoking stage, heating the semicoke by fluidization in said second semicoking stage at 800° to 1,100° C. for 10 to 60 minutes with the production of offgases while supplying to said second semicoking stage a make-up fluidizing gas comprising 0 to 70% by volume air and 30 to 100% by volume nitrogen in addition to that present in said air; and briquetting the semicoke from said second semicoking stage into formed coke; the improvement comprising substantially reducing the residual sulfur content of the formed coke to about 0.4% by weight by recycling to said first semicoking stage at fluidizing gas 15 to 95% by volume of said residual gases; and recycling to said second semicoking stage as fluidizing gas 15 to 95% by volume of said offgases from said second semicoking stage.

* * * * *